United States Patent [19]

Bursk et al.

[11] 4,079,550

[45] Mar. 21, 1978

[54] COMPOSITE SILL ASSEMBLY

[75] Inventors: William M. Bursk, Middletown; David H. Pease, Jr., Wyoming, both of Ohio

[73] Assignee: Pease Company, Fairfield, Ohio

[21] Appl. No.: 759,666

[22] Filed: Jan. 17, 1977

[51] Int. Cl.[2] ..... E06B 1/70

[52] U.S. Cl. ..... 49/467; 428/344; 428/354

[58] Field of Search ..... 49/467, 468, 469, 470, 49/471; 428/344, 354, 906, 420; 52/179, 188

[56] References Cited

U.S. PATENT DOCUMENTS

| | | | |
|---|---|---|---|
| 1,348,396 | 8/1920 | Dubee | 49/467 |
| 2,318,184 | 5/1943 | Rojas | 428/420 |
| 3,118,192 | 1/1964 | West | 49/469 |
| 3,900,967 | 8/1975 | Bursk et al. | 49/468 |

FOREIGN PATENT DOCUMENTS

| | | | |
|---|---|---|---|
| 1,577,828 | 6/1969 | France | 52/179 |

*Primary Examiner*—Philip C. Kannan

*Attorney, Agent, or Firm*—Biebel, French & Nauman

[57] ABSTRACT

A composite sill assembly including a core covered by an extruded section of aluminum cladding and a cover plate of brass fastened to the outer surface of the cladding to improve the appearance of the assembly without appreciably increasing its cost. Opposing surfaces of the cover plate and cladding are isolated from each other to prevent corrosion through galvanic action and this may be accomplished by adhering the cover plate to the cladding with a double faced adhesive tape of foamed neoprene or other suitable material. In this construction the tape therefore serves the dual function of both securing the plate to the cladding and isolating the two members from each other to prevent galvanic reaction and corrosion.

7 Claims, 2 Drawing Figures

COMPOSITE SILL ASSEMBLY

BACKGROUND OF THE INVENTION

In U.S. Pat. No. 3,900,967, issued Aug. 26, 1975, a sill construction is disclosed which includes a base member covered by a cladding of extruded aluminum. This provides a highly satisfactory construction in that the aluminum cladding backed by the base member of molded plastic or the like results in a strong, durable sill which is not unduly expensive since the cladding may be produced as an extruded section cut to length and slipped over previously molded or otherwise formed base members.

Solid brass sills, while generally considered desirable for both reasons of appearance and durability, are substantially more expensive than aluminum clad sills of the type disclosed in the above noted patent and consequently comprise only a small portion of the market.

While a brass clad sill appears theoretically possible and would presumably be significantly less expensive than solid brass sills, as a practical matter brass cladding does not lend itself to manufacture by extrusion to the cross sectional shapes desired, and other methods of producing brass cladding would result in an appreciable increase in manufacturing costs.

SUMMARY OF THE INVENTION

A composite sill in accordance with the present invention includes a base which may be of molded plastic or the like, an extruded aluminum cladding and a stamped brass cover plate adhered to at least the outside tread portion of the aluminum cladding with the cover plate and cladding isolated from each other to prevent galvanic action and resulting corrosion.

In a preferred embodiment of the invention the cover plate is "coined," that is, stamped with a decorative pattern embossed in its outer surface, an effect which also cannot be obtained in a standard extrusion process, but which can greatly improve the sill appearance.

Preferably the cover plate is attached to the cladding using a material which both securely fastens the cover plate in position and isolates the cover plate from the cladding to prevent galvanic action and resultant corrosion. In this regard a commercially available foamed neoprene tape having adhesive on both faces thereof has been found to perform satisfactorily in both respects.

If for any reason additional securement is deemed desirable, mechanical fasteners, such as grooved nails with decorative or embossed heads, can be used to attach the cover plate in place. If this type of securement is utilized provision should be made for isolating the cover plate from the cladding where the metal fasteners would otherwise interconnect them.

While it is contemplated that sills in accordance with the present invention will be sold assembled with the cover plate attached to the cladding, it will be apparent that dealers in building hardware can carry in stock a quantity of the standard aluminum clad sills, brass cover plates and attachment means such as the double faced tape described above, and modify standard sills as necessary to meet specific orders. Additionally, building owners might purchase cover plates and double faced tape or other attaching-isolating means to convert existing installed sills.

DESCRIPTION OF THE PREFERRED EMBODIMENTS

Figure 1:
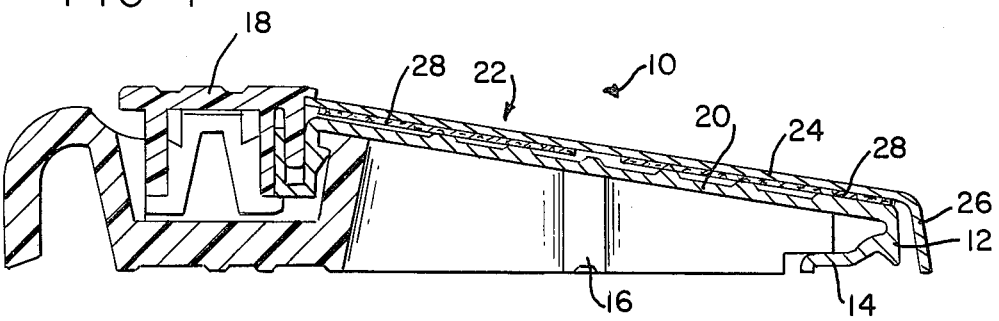
FIG. 1 is a cross-sectional view of a composite sill in accordance with the present invention.

As seen in the drawings, the sill assembly 10 of the present invention includes cladding 12 having a reversely bent portion 14 which partially defines a cavity or core-receiving chamber in which is secured a molded sill core 16. If desired, the sill may also include an adjustable section 18 as described in detail in the above noted U.S. patent.

The cladding includes an outer, sloped tread portion 20 to which is attached the cover plate 22. Cover plate 22 includes a tread portion 24 which corresponds to and overlies the tread portion 20 of the cladding 12 and an outer, downwardly depending section 26 covering the outer end of the sill assembly.

Preferably the cover plate 22 is attached to the cladding 12 by means of strips of double faced tape 28 which are interposed between the cladding and the cover plate and serve not only to fasten the cover plate to the cladding, but to isolate these two elements from each other and prevent galvanic action and resultant corrosion.

Figure 2:
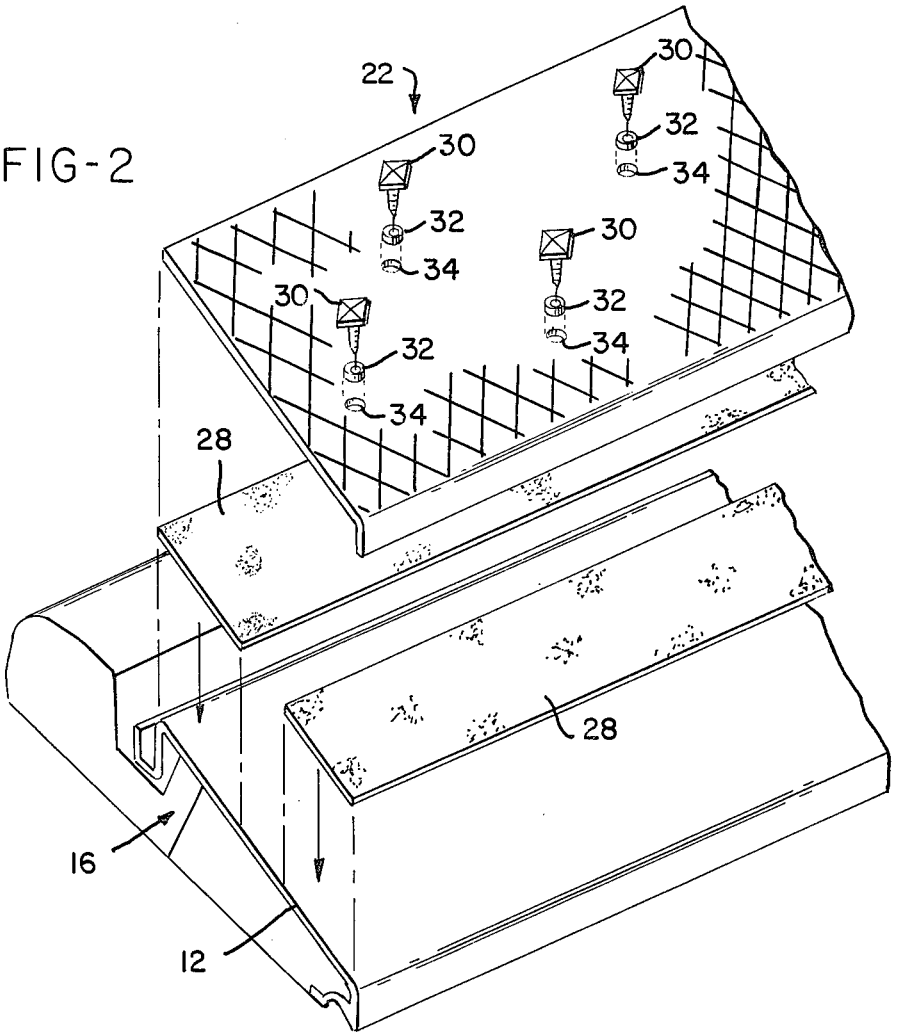
FIG. 2 is an exploded perspective view of a portion of the sill of FIG. 1.

This can be seen particularly in FIG. 1 of the drawings where it will be noted that at no point are the cover plate and cladding in contact with each other. As shown in FIG. 2 of the drawings, the cover plate may be provided with a decorative, embossed pattern on its outer surface which can be formed when the plate is stamped or coined.

It will also be noted from FIG. 2 of the drawings that if additional attachment in the form of nails or the like 30 are desired means should be provided for preventing electrical interconnection of the cladding and cover plate by such metallic fasteners.

From the above it will be seen that the present invention provides an improved sill assembly which includes many of the desirable features of the much more expensive solid brass sills and yet, in comparison to solid sills of that type is relatively inexpensive.

While the articles herein described constitute preferred embodiments of the invention, it is to be understood that the invention is not limited to these precise articles, and that changes may be made therein without departing from the scope of the invention.

What is claimed is:

1. A composite sill assembly comprising:

an extruded metal cladding including an outer tread portion terminating in a reversely extending section and partially defining a hollow, core-receiving portion, a core member positioned within said hollow, core-receiving portion of said metal cladding in supporting relationship thereto, a metal cover plate formed of a metal different from the metal of said cladding and positioned in overlying relationship to said outer tread portion of said cladding, and means permanently securing said cover plate to said cladding with opposed surfaces of said cover plate and cladding in spaced relationship to each other, isolating said cladding from said metal cover plate and preventing galvanic action therebetween.

2. The assembly of claim 1 wherein:

said securing means comprises a double-faced adhesive tape interposed between opposing surfaces of said cladding and said cover plate and preventing contact therebetween.

3. The assembly of claim 1 wherein:

said cladding consists of an aluminum extrusion.

4. The assembly of claim 1 wherein:

said cover plate consists of an embossed brass stamping.

5. The assembly of claim 1 wherein:

said core is formed of a synthetic resinous material.

6. The assembly of claim 1 further comprising:

mechanical fasteners extending between said cladding and said cover plate.

7. A composite sill assembly comprising:

an extruded aluminum cladding including an outer, sloped tread portion and a reversely extending section defining with said sloped tread portion a hollow, core-receiving portion of said threshold assembly, a molded synthetic resinous core secured within said hollow, core-receiving portion of said metal cladding in supporting relationship thereto, a coined brass cover plate with an embossed outer surface positioned in overlying relationship to said outer tread portion of said cladding, and a foamed neoprene tape having adhesive on opposite faces thereof, interposed between and securing said cover plate to said cladding, maintaining opposing surfaces thereof out of contact with each other and preventing galvanic corrosion thereof.

* * * * *